US008480191B1

(12) United States Patent
Fredricks et al.

(10) Patent No.: US 8,480,191 B1
(45) Date of Patent: Jul. 9, 2013

(54) STORAGE APPARATUS

(75) Inventors: Maurice Fredricks, Grand Haven, MI (US); Bruce Fredricks, Grand Haven, MI (US); Mitchell Mulder, North Muskegon, MI (US); Tony Dimovski, Macomb, MI (US)

(73) Assignee: Fredricks Design, Inc., Grand Haven, MI (US)

( * ) Notice: Subject to any disclaimer, the term of this patent is extended or adjusted under 35 U.S.C. 154(b) by 155 days.

(21) Appl. No.: 12/815,016

(22) Filed: Jun. 14, 2010

Related U.S. Application Data

(60) Provisional application No. 61/268,468, filed on Jun. 12, 2009.

(51) Int. Cl.
*A47B 97/00* (2006.01)

(52) U.S. Cl.
USPC ..... 312/249.11; 312/249.12; 280/47.35

(58) Field of Classification Search
USPC ..... 312/209, 244, 290, 249.1, 249.8, 312/249.11, 249.13, 294, 308, 330.1, 223.2, 312/223.3, 249.12, 351.3, 351.4, 351.11; 280/47.35, 47.34, 79.2, 79.11
See application file for complete search history.

(56) References Cited

U.S. PATENT DOCUMENTS

| | | | | |
|---|---|---|---|---|
| 2,113,995 | A * | 4/1938 | Salvage | 312/249.12 |
| 3,251,568 | A * | 5/1966 | Moe et al. | 248/649 |
| 3,949,902 | A * | 4/1976 | Thompson | 222/129.1 |
| 4,095,859 | A * | 6/1978 | Decker et al. | 312/209 |
| 4,931,978 | A * | 6/1990 | Drake et al. | 361/679.2 |
| 4,976,450 | A * | 12/1990 | Ellefson | 280/79.11 |
| 5,016,948 | A * | 5/1991 | Welch et al. | 312/249.12 |
| 5,399,007 | A * | 3/1995 | Marconet | 312/209 |
| 5,518,310 | A * | 5/1996 | Ellman et al. | 312/249.12 |
| 6,123,346 | A * | 9/2000 | Baldwin | 280/47.35 |
| 6,169,655 | B1 * | 1/2001 | Helot | 361/679.44 |
| 6,626,686 | B1 * | 9/2003 | D'Souza et al. | 439/131 |
| 2002/0171335 | A1 * | 11/2002 | Held | 312/223.6 |
| 2005/0218616 | A1 * | 10/2005 | Copeland et al. | 280/47.35 |
| 2009/0096336 | A1 * | 4/2009 | Petrick et al. | 312/237 |

* cited by examiner

*Primary Examiner* — James O Hansen
(74) *Attorney, Agent, or Firm* — The Watson IP Group, PLC; Jovan N. Jovanovic

(57) ABSTRACT

A storage apparatus comprising a basket assembly, a drawer assembly, a bin assembly and a charging assembly. The basket assembly has a pair of basket components defining a cavity, a shelf member extending between the pair of basket components and a plurality of barrier members extending between the pair of basket components. The drawer assembly is slidably positionable below the shelf member. The bin assembly positionable within the drawer assembly. The charging assembly positionable in one of the drawer assembly and the bin assembly.

9 Claims, 6 Drawing Sheets

STORAGE APPARATUS

CROSS-REFERENCE TO RELATED APPLICATION

Priority is claimed from U.S. Provisional Patent Application Ser. No. 61/268,468, filed Jun. 12, 2009, entitled "Storage Apparatus," the entire specification of which is hereby incorporated in its entirety.

BACKGROUND OF THE DISCLOSURE

1. Field of the Disclosure

The disclosure relates in general to a storage apparatus, and more particularly, to a storage apparatus which is suitably configured for use in an office environment, and which is suitable for both storage of various items, as well as charging electronic devices stored therewithin. It will be understood that the invention is not limited to use in such an environment.

2. Background Art

The use of storage apparatuses is well known in the art. A number of devices are typically utilized to store and handle office equipment, office supplies and bags/briefcases. Typically such devices have a number of different configurations.

While various combinations are available, there is nevertheless a need for configurations which provide storage capabilities as well as the ability to charge various electronic devices unobtrusively.

BRIEF DESCRIPTION OF THE DRAWINGS

The disclosure will now be described with reference to the drawings wherein.

DETAILED DESCRIPTION OF THE DISCLOSURE

Figure 1:
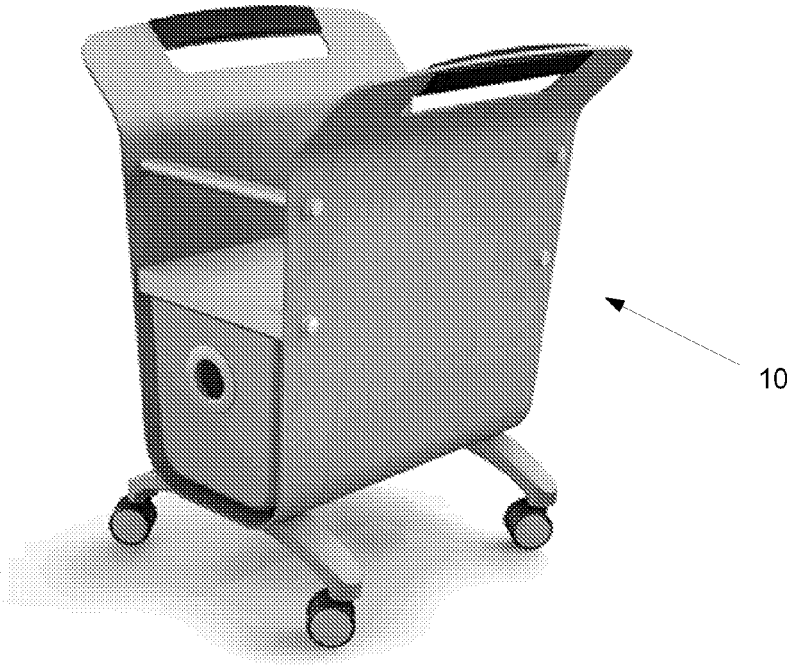
FIG. 1 shows a perspective view of the storage apparatus of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 4:
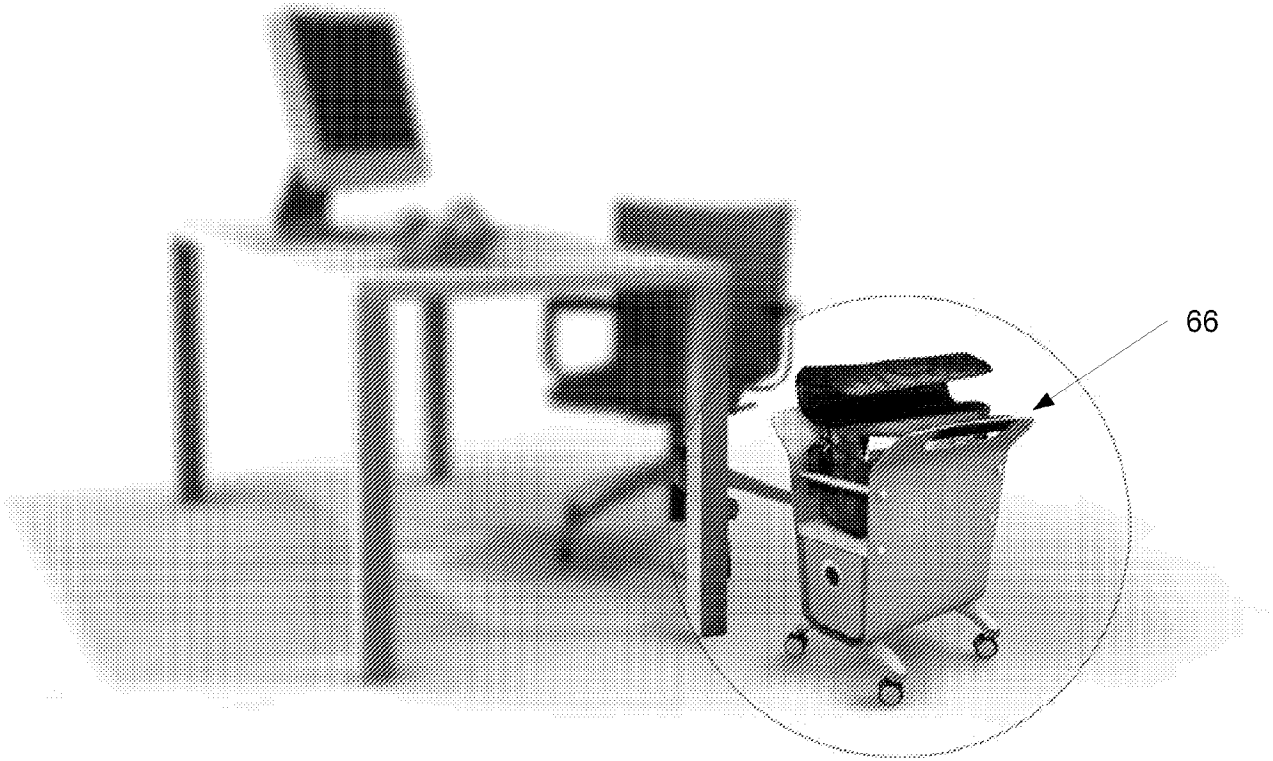
FIG. 4 shows the storage apparatus of the present invention in a use configuration.
Figure 5A:
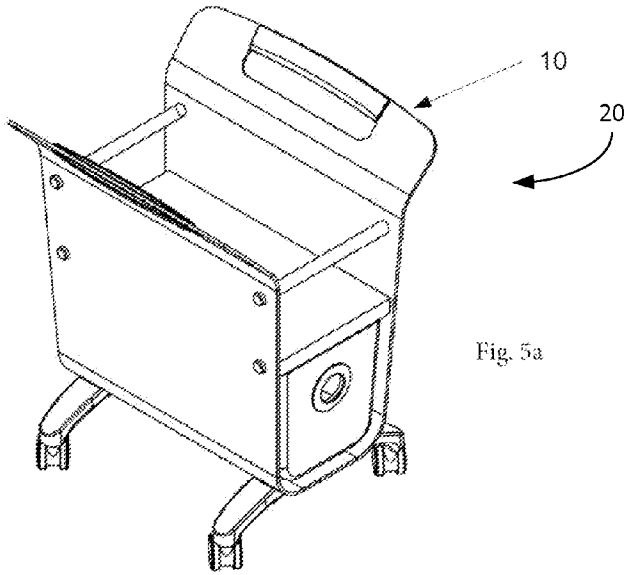
FIGS. 5*a*-5*d* show a plurality of views of the storage apparatus of the present invention.
Figure 5B:
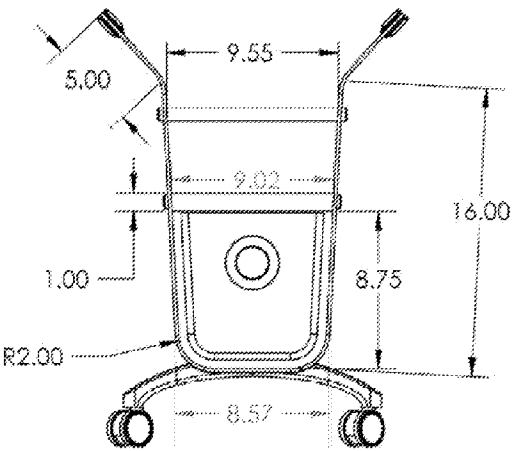
Figure 5D:
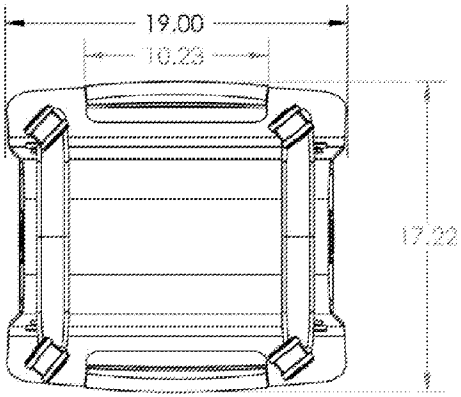
Figure 5C:
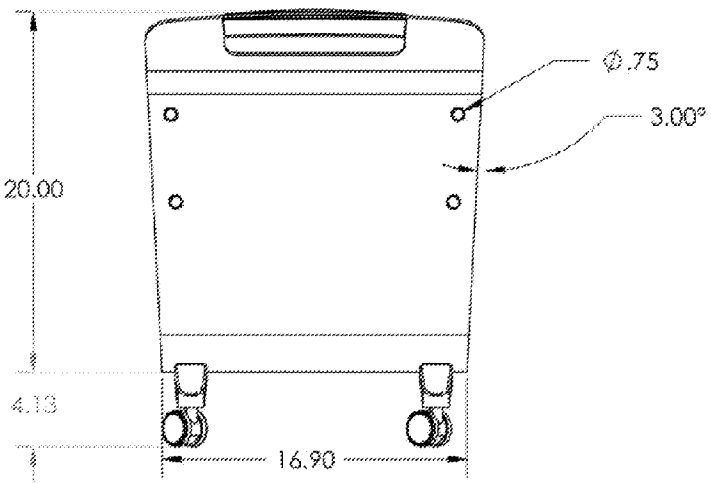

Referring now to the drawings and in particular to FIGS. 5*a*-5*d* and FIG. 6, the storage apparatus is shown generally at 10. The storage apparatus comprises basket assembly 20, drawer assembly 22, bin assembly 24 and charging system 26. The storage apparatus is configured for use in an office environment, as shown in FIG. 4. However, it will be understood that the storage apparatus is not limited to use in such an environment, and a number of different environments are contemplated.

Figure 6:
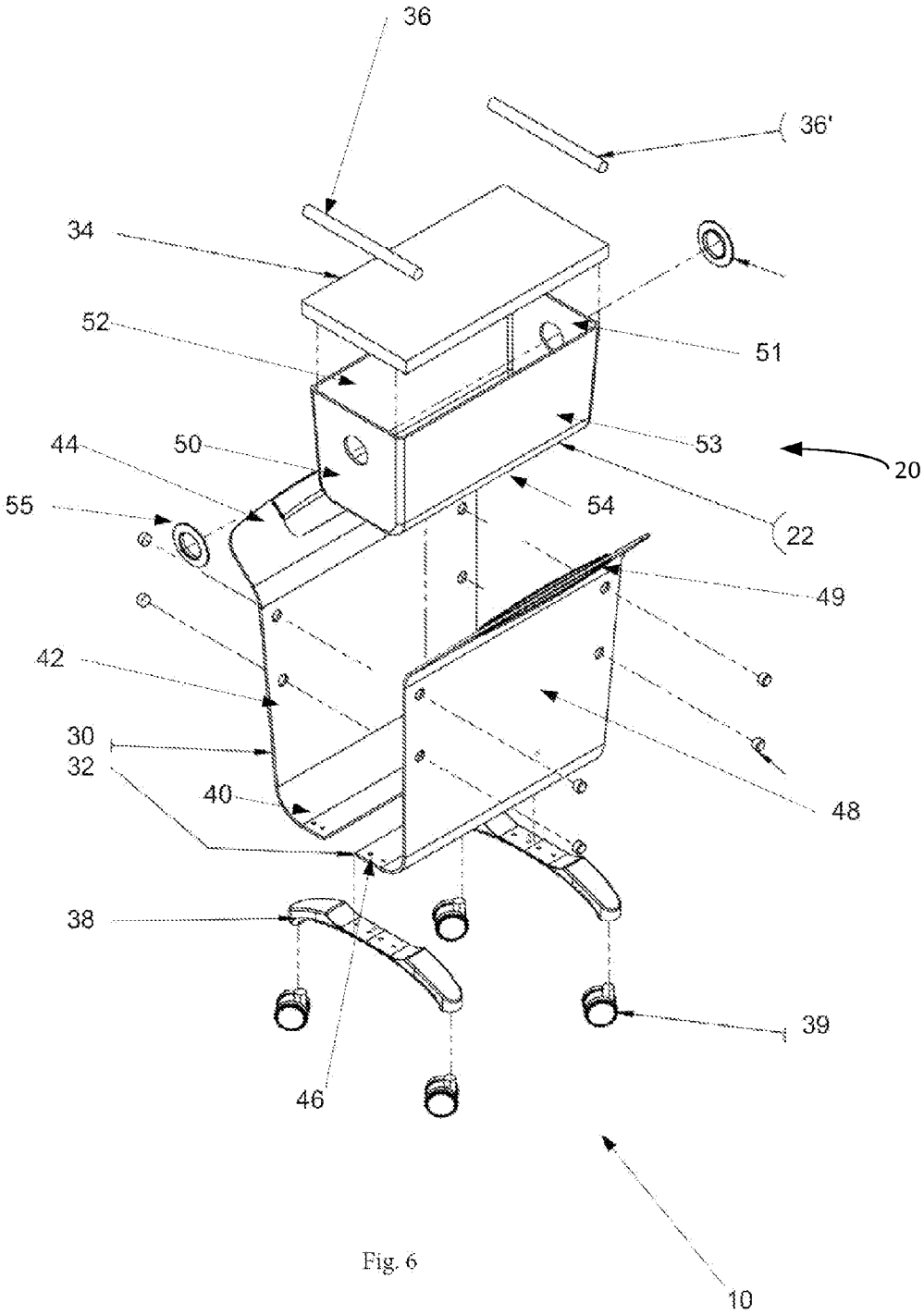
FIG. 6 shows an exploded view of the storage apparatus of the present invention.

The basket assembly 20 is shown in FIG. 6 as comprising first basket component 30, second basket component 32, shelf member 34, barrier member 36, leg member 38 and wheels, such as wheel 39. The first basket component comprises a base 40, side wall 42 and handle 44. Similarly, the second basket component comprises a base 46, sidewall 48 and handle 49. It will be understood that in the embodiment shown, the first and second basket components are substantially mirror images of each other. In other embodiments, the first and second basket components may be distinct and different from each other. In the embodiment shown, each basket component comprises a single shape manipulated member. For example, a single panel of wood may be shaped into the shapes shown in the Figures. In other embodiments, a metal panel may be bent into the desired configuration. In still other embodiments, a plastic panel may be molded or otherwise configured into the desired shape.

In the embodiment shown, a handle 44 is provided at the upper end of the respective basket component. A gripping member or a protective member may be positioned at the opening so as to facilitate grasping and moving of the overall storage apparatus. When assembled, the two basket components define a substantially U-shaped configuration having outwardly flared ends and define cavity 45 therebetween.

Shelf member 34 extends between the opposing basket components at some point on the respective side walls 42, 48. The shelf member 34 divides cavity 45 into an upper cavity 43 and a lower cavity 47. It will be understood that the shelf member provides additional stability to the storage apparatus, as it joins the two basket components to each other. While a single shelf is shown, it will be understood that multiple shelves may be utilized. Additionally, while the shelf is shown to be substantially uniform, a number of different configurations are contemplated.

At either side end of the storage apparatus, barrier members 36, 36' extend between the respective side walls 42, 48. The barrier members are positioned above the shelf member and serve to provide opposing side barriers across upper cavity 43 for purposes of containment. For example, a bag or briefcase can be positioned within the upper cavity 43 (upon the shelf member 34). The opposing side barriers preclude lateral movement of the bag or briefcase and keep the same from sliding off the shelf member. Of course, other barriers are contemplated for use, including wall structures that interface with the shelf and the like to provide additional containment for smaller items, as well as netting and the like. Additional barriers may also be provided to, for example, define a plurality of smaller sub cavities within the upper cavity 43.

Leg members, such as leg member 38, extend on opposing ends of the storage apparatus, and below the first and second basket components. The leg members straddle both of the basket components and can be utilized to join the basket components to each other. In the embodiment shown, the leg members may include wheels, such as wheels 39 which are coupled to the leg members at opposing ends thereof. The wheels allow for the relative mobility of the storage apparatus on a multitude of surfaces. In the embodiment shown, a total of four wheels are utilized. In other embodiments, the wheels can be replaced with pads or smaller leg-like members that interface with the ground and which may be adjustable to adjust for a multitude of different surfaces.

The drawer assembly 22 is shown in FIG. 6 as comprising front wall 50, back wall 51, first side wall 52, second side wall 53 and bottom wall 54. The drawer assembly 22 is configured to slidably be positionable within the lower cavity 47. A handle 55 can be positioned within front wall 50 so as to provide a means by which to move the drawer assembly relative to the basket assembly. Additional handles may also be provided.

Figure 2B:
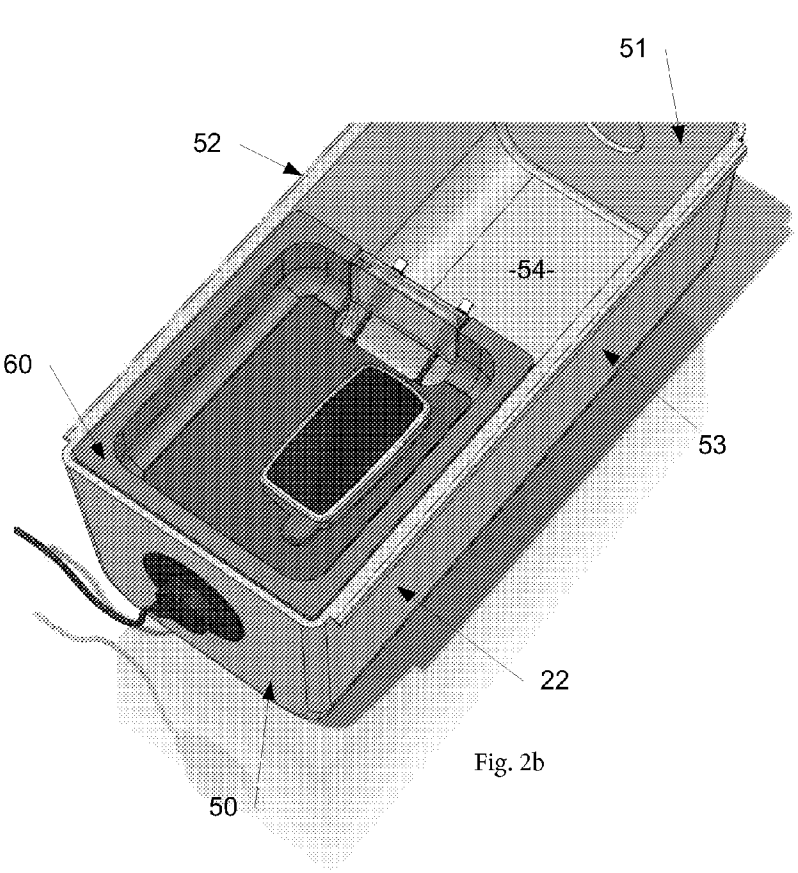
FIGS. 2*a*-2*c* show a plurality of views of an embodiment of the bin assembly of the present invention.
Figure 2A:
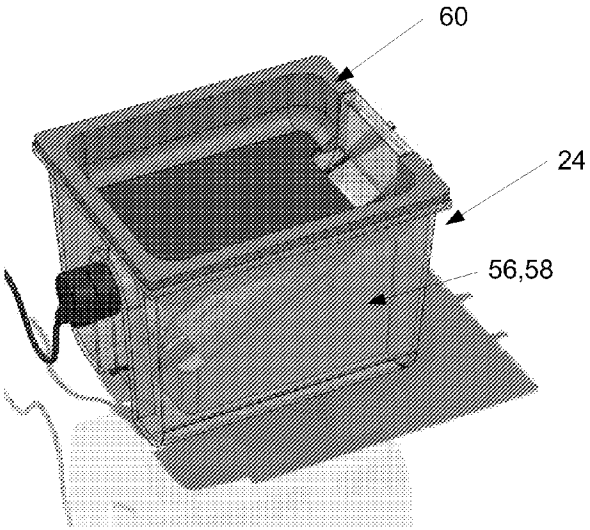
Figure 2C:
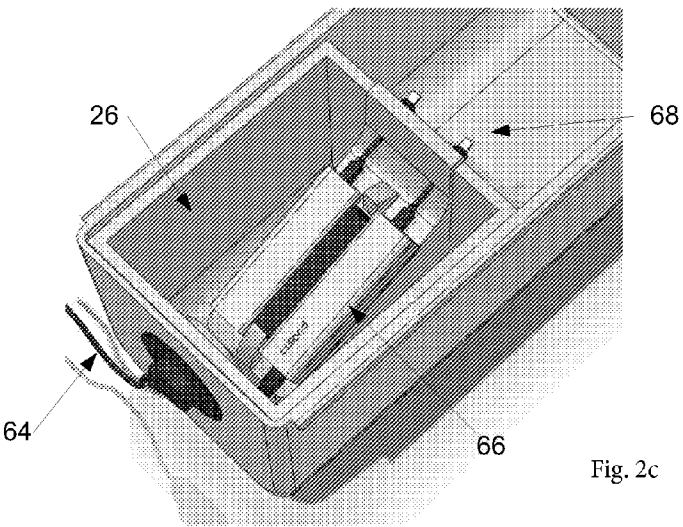

The bin assembly 24 is shown in FIG. 2*a* as comprising a shape matched member which can be inserted into the drawer assembly as shown in FIGS. 2*b*-2*c*. The bin assembly is shorter than the drawer assembly so that it can be positioned in multiple locations within the bin. Additionally, it is contemplated that multiple bin assemblies may be positioned within the drawer assembly. The bin assemblies can be utilized to provide smaller compartments for storage.

Figure 3A:
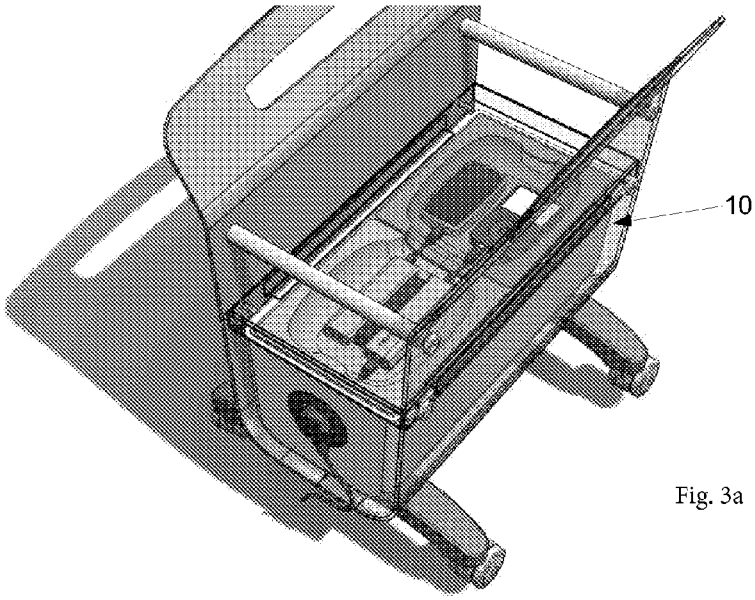
FIGS. 3*a*-3*c* show a plurality of configurations of the drawer assembly as well as bin assemblies in use in association with the storage apparatus of the present invention.
Figure 3B:
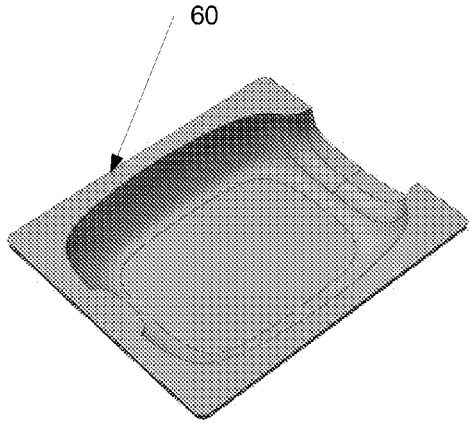
Figure 3C:
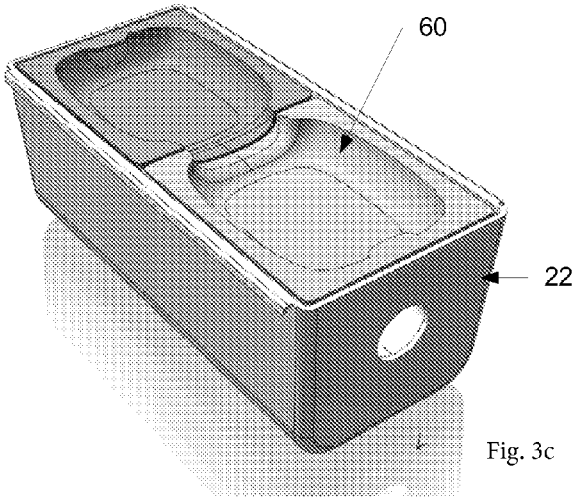

Additionally, a tray member 60, as shown in FIG. 3*b*, can be provided to cover the respective bin assembly. In certain embodiments, it will be understood that the tray member 60 may be configured for use directly with the drawer assembly as shown in FIG. 3*c*. The tray member provides a relatively shallow tray which can house various items, such as, for example, pencils, pens, cell phones, amongst others.

In one particular embodiment, the bin assembly may be configured to retain a charging system, such as charging system 26, shown in FIG. 2*c* and FIG. 3*a*. The charging system contemplated includes an outside power supply 64, an internal power supply 66 and connectors 68. The outside power supply 64 comprises a cord system which allows for connection with an outside power outlet (not shown). The internal power supply 66 comprises a power source, such as a battery. One example of such a battery is offered under the trademark "fueltank" and offered by Callpod, Inc. of Chicago, Ill.

In the embodiment shown, the internal power supply 66 is positioned in the bin assembly. An opening is provided through the drawer assembly and into the bin assembly for the external power supply. The external power supply enters into the bin assembly and can be coupled to the internal power supply. Connectors 68 extend from the internal power supply 66 and are extendible through an opening in the tray member. The connectors 68 can be coupled to an electronic device, such as a cell phone, a PDA, an iPod or the like, to charge the same. Inasmuch as the internal power supply and the cables are maintained in the bin assembly below the tray member, while the electronic device is maintained in the tray member, the user has easy access to the electronic device, without being tangled in the cables or the charging devices. Additionally, it is contemplated that the internal power supply can be disconnected from the external power supply from outside of the bin assembly and the drawer assembly, so as to minimize inconvenience to the user.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A storage apparatus comprising:

a basket assembly having a pair of basket components defining a cavity, the first basket component including a sidewall, a base curved inwardly at a lower end of the sidewall, and a handle curved outwardly at an upper end of the sidewall, the first basket component formed from a single monolithic member, and being substantially uniformly thick, the second basket component being a substantial mirror image of the first basket component, with each of the base of the first basket component and the base of the second basket component meeting in a head to head orientation, so as to define a substantially upwardly opening u-shaped configuration, substantially open at either end, a shelf member extending across from an inside surface of the sidewall of the first basket component to an inside surface of the sidewall of the second basket component, spaced apart from and substantially parallel to the base of the first and second basket components, and spaced apart from the handle, the first and second basket components together with the shelf member defining a lower cavity having a substantially uniform lower cavity cross-sectional configuration; and a plurality of barrier members extending between the pair of basket components, the barrier members extending from the inside surface of the sidewall of the first basket component to the inside surface of the sidewall of the second basket component spaced apart from each other and spaced apart from an upper surface of the shelf member, so as to be positioned to extend between the shelf member and the handle of each of the sidewalls of the first and second sidewalls;

a pair of leg members spaced apart from each other abutting a lower surface of the base of each of the first and second basket components, each of the pair of leg members coupled to each of the base of the first and second basket component, and each including a pair of wheel assemblies, spaced apart from each other at an opposing end of each of the pair of leg members;

a drawer spanning across the substantially uniform lower cavity cross-sectional configuration, the drawer being slidably movable within the lower cavity, in a direction that is parallel to the sidewalls of the first and second basket components; and a bin assembly positionable within the drawer.

2. The storage apparatus of claim 1 further comprising an opening extending through the first basket component and the second basket component at the handle, with a gripping member positioned thereat to facilitate grasping and moving of thereof.

3. The storage apparatus of claim 1 wherein the bin assembly is configured to rest on an upper edge of the drawer so as to provide a storage cavity therebelow defined by the bin assembly and the drawer, with the drawer further including an opening at an end thereof to facilitate handling, as well, as the passage of an electrical outlet therethrough.

4. The storage apparatus of claim 3 further comprising a charging assembly configured to charge an item positioned within the bin assembly, the charging assembly extending within the storage cavity.

5. The storage apparatus of claim 4 wherein the charging assembly is energized through one of the openings of the drawer.

6. The storage apparatus of claim 5 wherein the storage apparatus further comprises a second bin assembly positioned in an abutting relationship with the bin assembly.

7. The storage apparatus of claim 1 wherein the first basket component and the second basket component comprises a wood member that is bent into the appropriate configuration.

8. The storage apparatus of claim 1 wherein the barrier members are positioned proximate opposing sides of the sidewall, have a substantially circular cross-sectional configuration and are substantially parallel to each other.

9. The storage apparatus of claim 1 wherein the pair of leg members are substantially perpendicular to the slidable movement of the drawer, with the opposing ends extending outwardly beyond the sidewall and the handle at either opposing end thereof.

* * * * *